US009367028B2

(12) United States Patent
Uchiyama et al.

(10) Patent No.: US 9,367,028 B2
(45) Date of Patent: Jun. 14, 2016

(54) PACKING STRUCTURE OF DEVELOPER CONTAINER

(71) Applicant: FUJI XEROX CO., LTD., Tokyo (JP)

(72) Inventors: Keisuke Uchiyama, Kanagawa (JP); Makoto Kanno, Kanagawa (JP); Yuji Sakoda, Kanagawa (JP); Keisuke Kubo, Kanagawa (JP); Shinichiro Fujimori, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 164 days.

(21) Appl. No.: 13/693,302

(22) Filed: Dec. 4, 2012

(65) Prior Publication Data

US 2013/0315634 A1 Nov. 28, 2013

(30) Foreign Application Priority Data

May 22, 2012 (JP) ..... 2012-116593

(51) Int. Cl.

| | |
|---|---|
| ***G03G 15/08*** | (2006.01) |
| ***A45C 13/10*** | (2006.01) |
| ***A45C 13/18*** | (2006.01) |
| ***B65D 83/10*** | (2006.01) |
| ***G03G 21/16*** | (2006.01) |
| *G03G 21/18* | (2006.01) |

(52) U.S. Cl.

CPC ..... *G03G 21/1676* (2013.01); *G03G 15/0867* (2013.01); *G03G 21/181* (2013.01)

(58) Field of Classification Search

CPC ..... G03G 21/1676; G03G 15/0867; G03G 21/181

USPC ..... 399/262

See application file for complete search history.

(56) References Cited

U.S. PATENT DOCUMENTS

| | | | | |
|---|---|---|---|---|
| 2010/0098456 | A1 | 4/2010 | Murase et al. | |
| 2010/0329747 | A1 * | 12/2010 | Kouda | 399/262 |
| 2011/0091241 | A1 * | 4/2011 | Kim | G03G 21/181 399/117 |

FOREIGN PATENT DOCUMENTS

| | | |
|---|---|---|
| CN | 101685284 A | 3/2010 |
| JP | A-2000-199995 | 7/2000 |

OTHER PUBLICATIONS

Aug. 4, 2015 Office Action issued in Chinese Application No. 201310006856.5.

* cited by examiner

*Primary Examiner* — David Gray
*Assistant Examiner* — Tyler Hardman
(74) *Attorney, Agent, or Firm* — Oliff PLC

(57) ABSTRACT

Disclosed is a packing structure of a developer container, including a developer container that contains a developer and is formed with a supply port for supply of the developer, a transport member that is provided in the developer container and transports the developer to the supply port while stirring the developer, a packing member that packs the developer container from an end portion of the transport member in an axial direction thereof to a central portion of the transport member in the axial direction, and a unit that moves the transport member by an operation of detaching the packing member from the developer container.

6 Claims, 11 Drawing Sheets

PACKING STRUCTURE OF DEVELOPER CONTAINER

CROSS-REFERENCE TO RELATED APPLICATIONS

This application is based on and claims priority under 35 USC 119 from Japanese Patent Application No. 2012-116593 filed May 22, 2012.

BACKGROUND

Technical Field

The present invention relates to a packing structure of a developer container.

SUMMARY

According to an aspect of the invention, there is provided a packing structure of a developer container, including: a developer container that contains a developer and is formed with a supply port for supply of the developer; a transport member that is provided in the developer container and transports the developer to the supply port while stirring the developer; a packing member that packs the developer container from an end portion of the transport member in an axial direction thereof to a central portion of the transport member in the axial direction; and a unit that moves the transport member by an operation of detaching the packing member from the developer container.

BRIEF DESCRIPTION OF THE DRAWINGS

Exemplary embodiments of the present invention will be described in detail based on the following figures, wherein.

DETAILED DESCRIPTION

Hereinafter, exemplary embodiments according to the invention will be described in detail with reference to the accompanying drawings. For ease of description, a rotation axis direction of a rotating transport member 20, that is an example of a transport member, may be referred to as an axial direction of a developer supply container 10, that is an example of a developer container, or an axial direction of a container main body 12 thereof.

Figure 2:
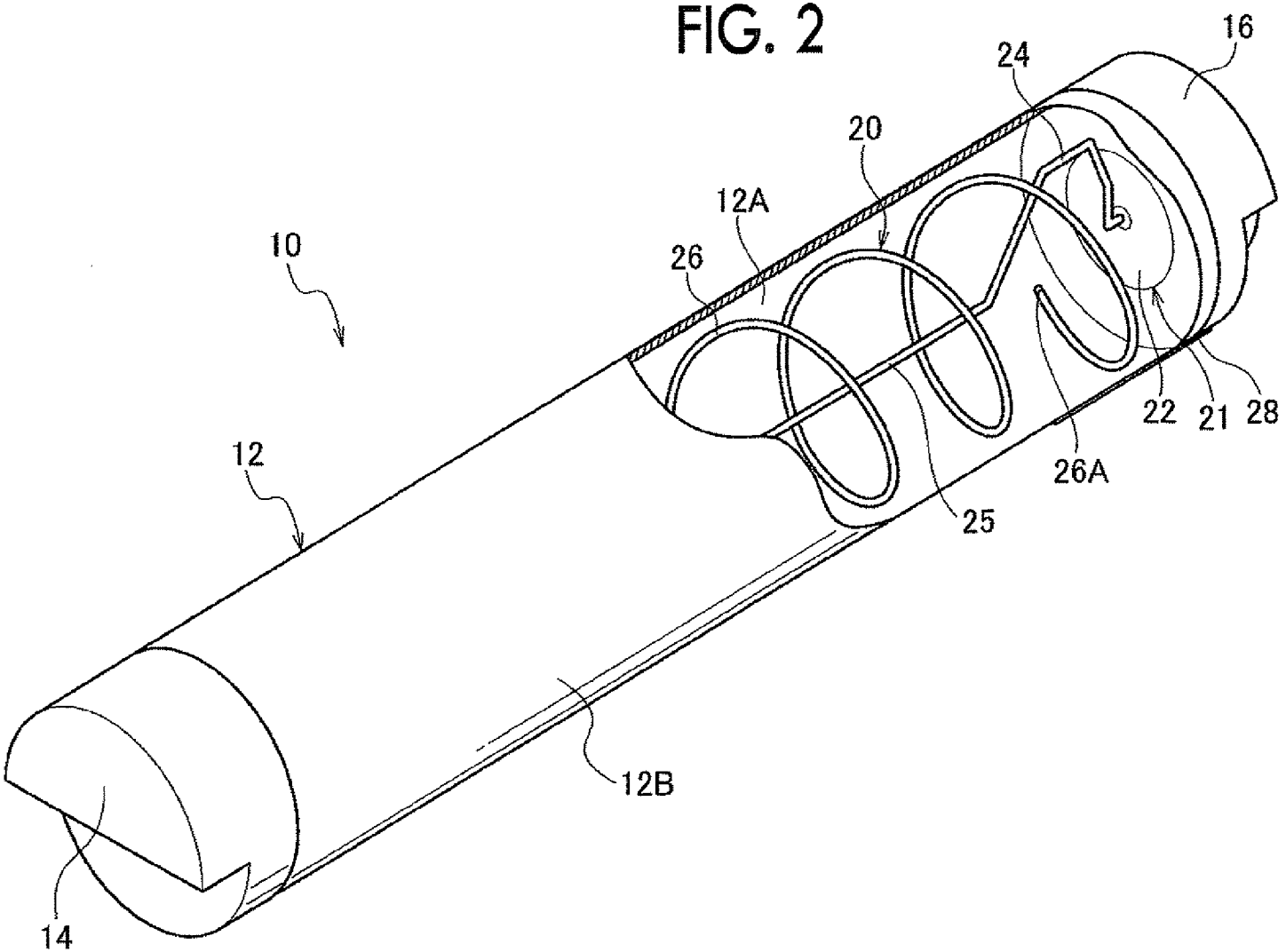
FIG. 2 is a partial cutaway perspective view illustrating the shape of a rotating transport member of a developer supply container.
Figure 3:
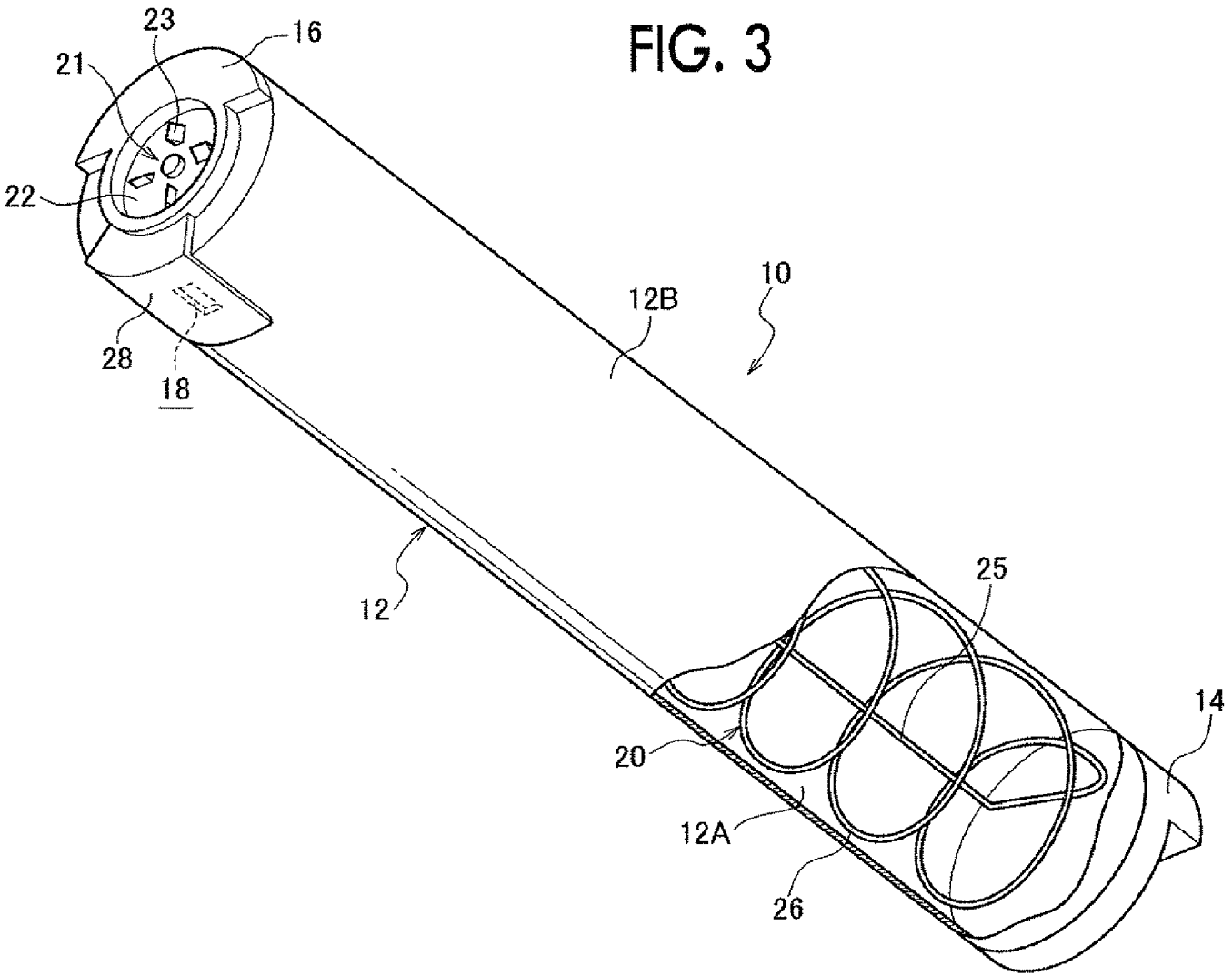
FIG. 3 is a partial cutaway perspective view illustrating the shape of a rotating transport member of a developer supply container.

Firstly, a packing structure 11 of the developer supply container 10 according to a first exemplary embodiment will be described. As shown in FIGS. 2 and 3, the developer supply container 10 includes the container main body 12 formed in an approximately cylindrical shape, and a rotating transport member 20 that is rotatably provided inside the container main body 12. One end portion of the container main body 12 in the axial direction is covered by a cover member 14.

Further, a coupling 21 that is an example of an engaging section, to which a rotational driving force is transmitted from an image forming apparatus main body (not shown) to which the developer supply container 10 is mounted, is rotatably provided at the axial center portion of the other end portion of the container main body 12 in the axial direction. Further, the other end portion of the container main body 12 in the axial direction is blocked by the coupling 21 and an annular supporting member 16 that rotatably supports the coupling 21.

The coupling 21 has a configuration in which plural (four at equivalent intervals in the figure) engaging teeth 23 are formed on an outer face of an approximately disk-shaped main body 22, and serves as a component of the rotating transport member 20. The rotating transport member 20 includes a linear section 25 that linearly extends from the axial center portion in an inner face of the main body 22 of the coupling 21 toward the one end portion in the axial direction through a bending portion 24 that bends in an approximately U shape to the outside in the radial direction, and a transport section 26 formed in a spiral shape from the one end portion of the linear section 25 in the axial direction toward the other end portion in the axial direction.

According to this configuration, as the coupling 21 is rotated by the rotational driving force transmitted from the image forming apparatus main body, the transport section 26 rotates and moves along an inner circumferential face 12A of the container main body 12. Thus, a powder developer (not shown), including at least a toner, contained in the container main body 12 is transported from the one end portion to the other end portion (the coupling 21) of the container main body 12 in the axial direction while being stirred.

Further, on the other end portion of the container main body 12 in the axial direction (the coupling 21), an approximately rectangular supply port 18 for supply of the developer that is transmitted while being stirred by the transport section 26 to a developing unit (not shown) that is mounted to the image forming apparatus main body is formed. Further, the supply port 18 is configured to be opened and closed by an opening and closing member 28 that is slidably provided on an outer circumferential face 12B of the container main body 12.

The opening and closing member 28 is maintained in a state of closing the supply port 18 until the developer supply container 10 is mounted to the image forming apparatus main body, and slides in a circumferential direction of the outer circumferential face 12B to open the supply port 18 as the developer supply container 10 is mounted to the image forming apparatus main body. The opening and closing member 28 is an example of a protruding member that is provided on the outer circumferential face 12B of the container main body 12.

Figure 1:
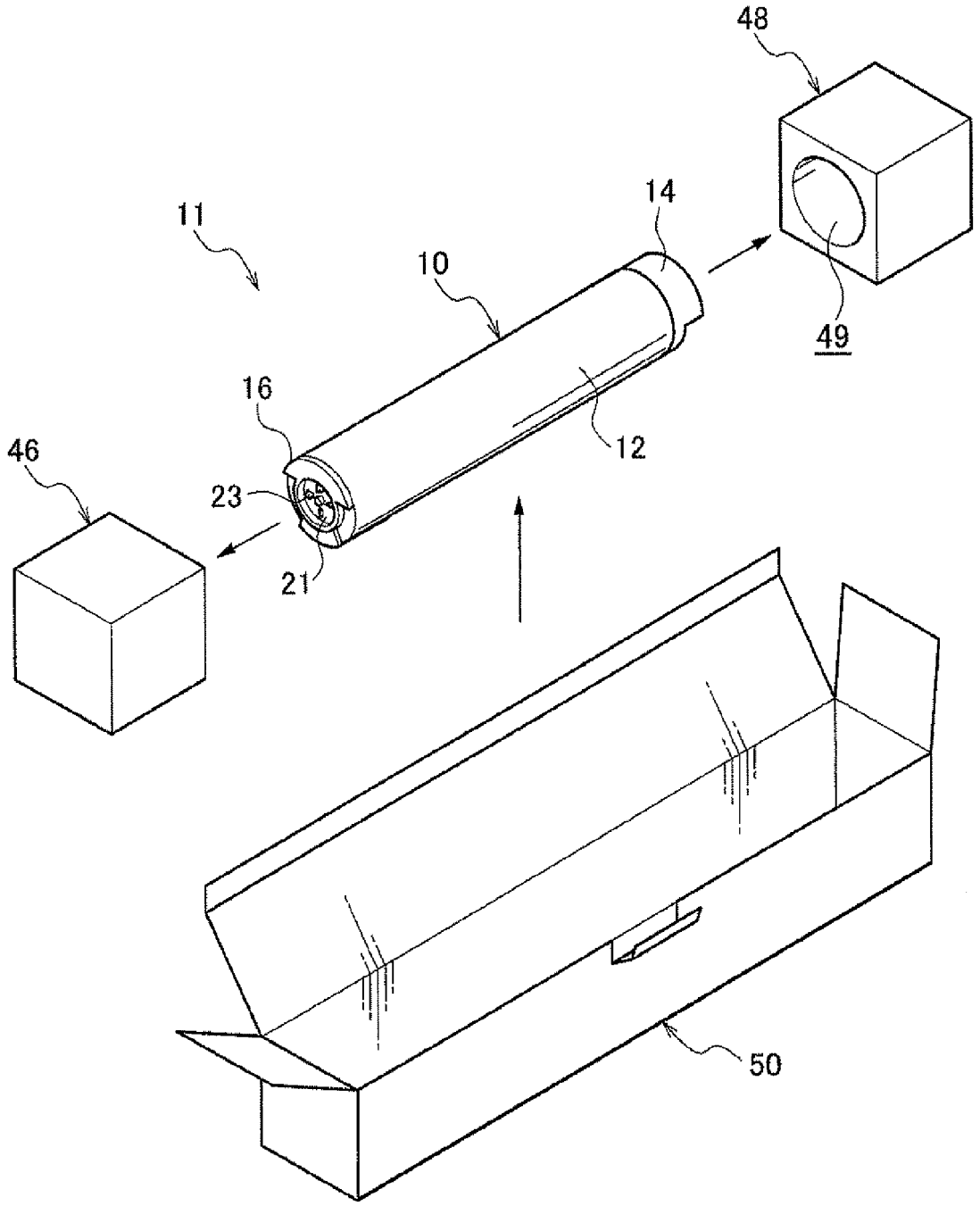
FIG. 1 is a perspective view schematically illustrating a configuration of a packing structure of a developer supply container.

As shown in FIG. 1, the developer supply container 10 having such a configuration is packed by packing members 46 and 48 in which opposite end portions in the axial direction are approximately rectangular box shapes (from the opposite end portions in the axial direction toward the central portion in the axial direction), and is accommodated in a packing box 50 in this state for distribution (shipping, transport, storage or the like).

The respective packing members 46 and 48 are configured by expanded polystyrene, corrugated cardboard or the like. Further, approximately circular concave portions 47 and 49 when seen from the axial direction are respectively formed in the packing members 46 and 48 (see FIG. 4). That is, as the opposite end portions of the developer supply container 10 in the axial direction are inserted into the respective concave portions 47 and 49 of the packing members 46 and 48, the opposite end portions in the axial direction are packed.

Figure 4:
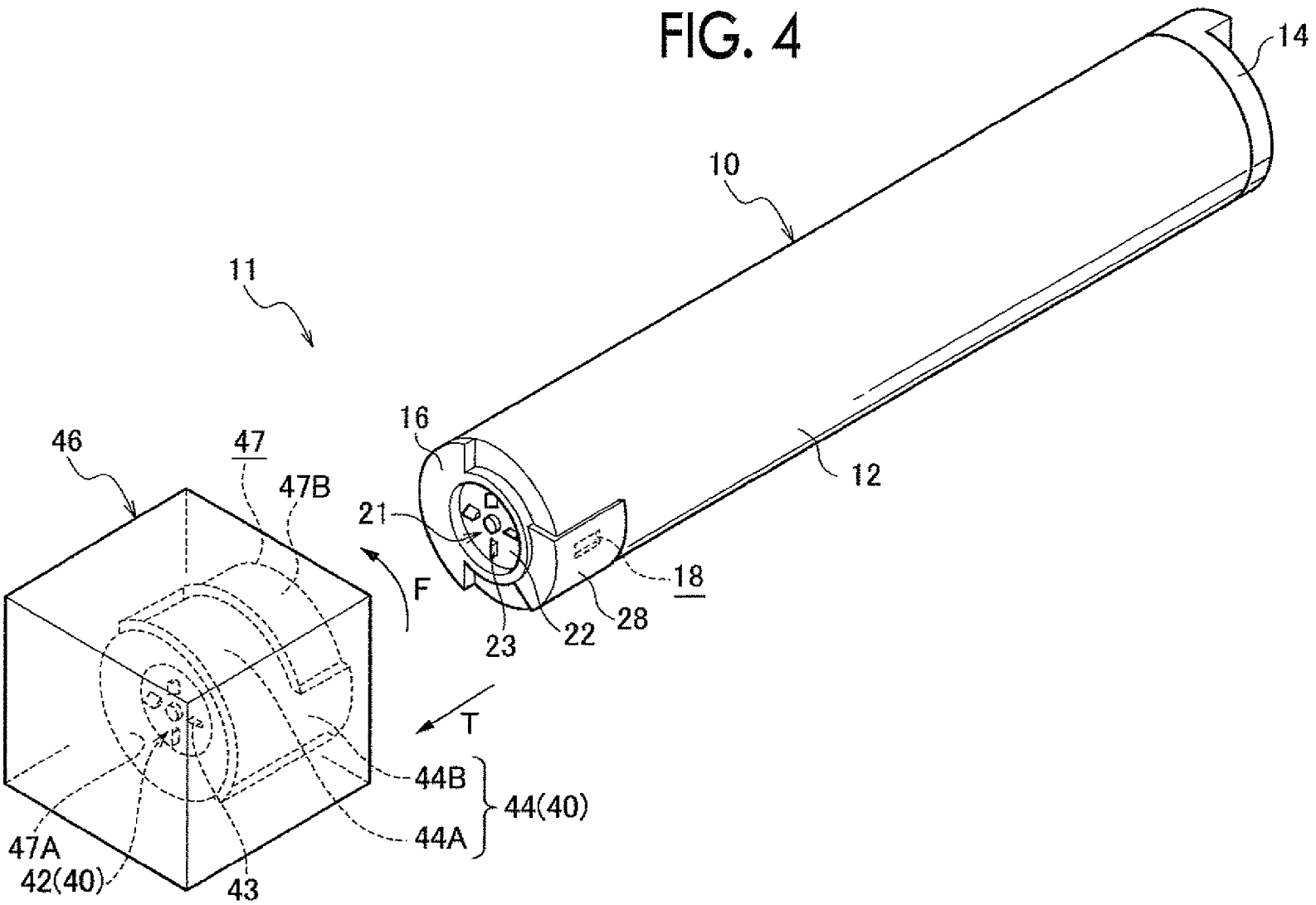
FIG. 4 is a perspective view illustrating a configuration of a packing structure according to a first exemplary embodiment.

Further, as shown in FIG. 4, a resin coupling 42 that is an example of an engaging target section that includes engaging target teeth 43 that are engaged with the engaging teeth 23 of the coupling 21 in the state of being packed by the packing member 46 is attached to a bottom face 47A of the concave portion 47 of the packing member 46 that packs the other end portion of the developer supply container 10 in the axial direction (the coupling 21). Further, on an inner circumferential face 47B of the concave portion 47, a groove section 44 is formed to guide the opening and closing member to move at least in the circumferential direction (specifically, in the circumferential and axial directions).

That is, the groove section 44 includes a guide groove 44A that guides the opening and closing member 28 in the circumferential direction when the packing member 46 is detached from the developer supply container 10, and a guide groove 44B that continuously guides the opening and closing member 28 in the axial direction (toward the opening of the concave portion 47) from one end portion of the guide groove 44A in the circumferential direction. Thus, in a state where the coupling 21 and the coupling 42 are engaged with each other, the packing member 46 is rotated with respect to the developer supply container 10.

That is, the groove section 44 and the coupling 42 form a unit 40 that moves the rotating transport member 20 by an operation of detaching the packing member 46 from the developer supply container 10. The coupling 42 (the engaging target teeth 43) is not attached to the bottom face 47A of the concave portion 47, in a case where the packing member 46 is the expanded polystyrene, and may be directly formed on the bottom face 47A.

In the packing structure 11 of the developer supply container 10 according to the above-described first exemplary embodiment, operations thereof will be described as follows.

When a new developer supply container 10 is mounted to the image forming apparatus main body, as shown in FIG. 1, the developer supply container 10 is detached from the packing box 50 for the respective packing members 46 and 48. Then, the respective packing members 46 and 48 that pack the opposite end portions of the developer supply container 10 in the axial direction are detached from the opposite end portions of the developer supply container 10 in the axial direction, respectively.

Here, the groove section 44 is formed on the inner circumferential face 47B of the concave portion 47 of the packing member 46 that packs the other end portion (the coupling 21) of the developer supply container 10 in the axial direction, and the opening and closing member 28 is accommodated in the other end portion of the circumferential guide groove 44A of the groove section 44. Accordingly, when the packing member 46 is detached from the other end portion of the developer supply container 10 in the axial direction, firstly, the packing member 46 rotates in an arrow direction F shown in FIG. 4, for example, so that the opening and closing member 28 moves along the guide groove 44A.

Then, since the engaging teeth 23 of the coupling 21 of the developer supply container 10 are engaged with the engaging target teeth 43 of the coupling 42 formed on the bottom face 47A of the concave portion 47 of the packing member 46, the coupling 21 is rotated by the rotation of the packing member 46 (coupling 42). Accordingly, the transport section 26 of the rotating transport member 20 rotates and moves along the inner circumferential face 12A of the container main body 12.

Accordingly, even though the developer contained in the developer supply container 10 is compressed, agglomerated and solidified by vibration applied thereto at the time of distribution, long-term storage or the like (particularly, vertically placed), the agglomeration and solidification of the developer is loosened by the operation of detaching the packing member 46 from the developer supply container 10 as described above.

Accordingly, an initial driving torque (rotational resistance of the rotating transport member 20) with respect to the rotating transport member 20 is reduced when the developer supply container 10 is mounted to the image forming apparatus main body. Further, accordingly, increase in power consumption in the image forming apparatus main body is suppressed or prevented, and increase in the size of a motor (not shown) that rotates the rotating transport member 20 and increase in cost are suppressed or prevented.

A direction where the transport section 26 is rotated by the guide groove 44A may be a transport direction where the developer is transported to the supply port 18, or may be a direction that is reverse to the transport direction. Particularly, in a configuration in which the guide groove 44A guides the opening and closing member 28 so that the transport section 26 is rotated in the direction that is reverse to the transport direction, in a case where the developer supply container 10 is stored so that the supply port 18 is directed downward in the vertical (gravity) direction and the developer is agglomerated and solidified, since the developer moves toward the side opposite to the supply port 18, the agglomeration and solidification of the developer is effectively loosened.

In this way, if the packing member 46 is rotated in the arrow direction F (transport direction or direction that is reverse to the transport direction) so that the opening and closing member 28 moves along the guide groove 44A, the packing member 46 moves to the outside in the axial direction (arrow direction T) so that the opening and closing member 28 moves along the guide groove 44B. Thus, the packing member 46 is detached from the developer supply container 10.

Next, the packing structure 11 of the developer supply container 10 according to a second exemplary embodiment will be described. The same reference numerals are given to the equivalent portions as those in the first exemplary embodiment, and detailed description thereof will be omitted.

Figure 5:
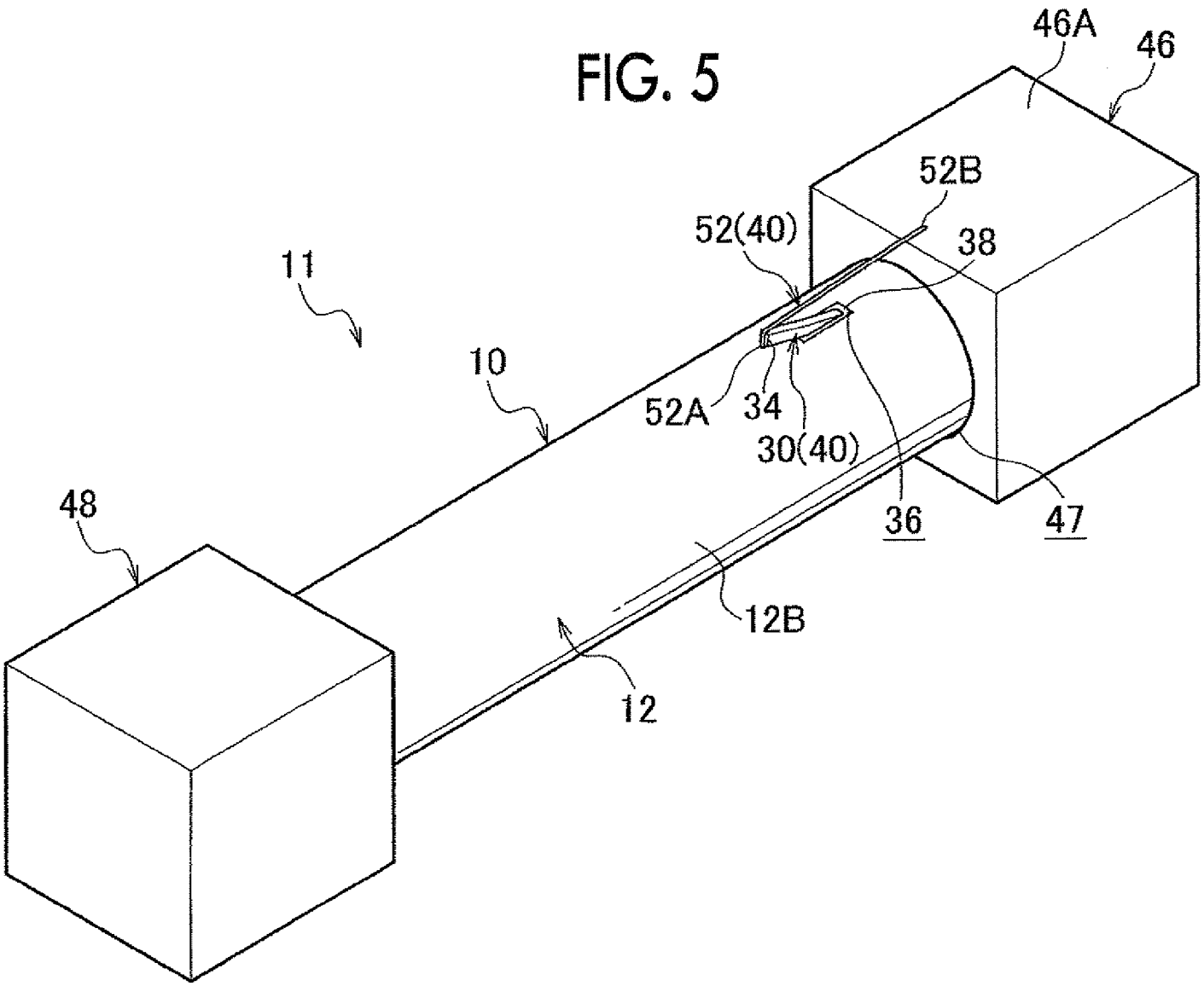
FIG. 5 is a perspective view illustrating a position regulated state of a packing structure according to a second exemplary embodiment.
Figure 6:
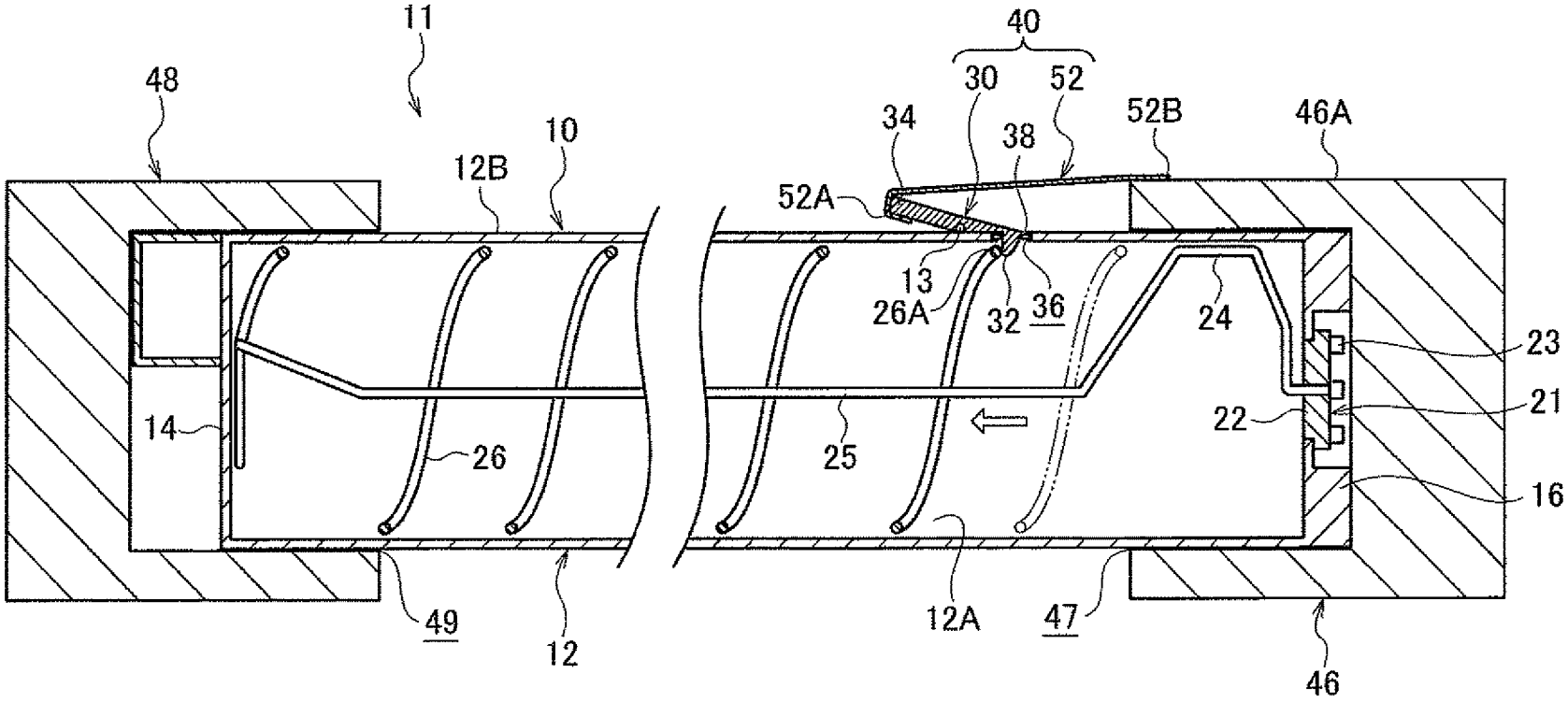
FIG. 6 is a cross-sectional view illustrating the position regulated state of the packing structure according to the second exemplary embodiment.

As shown in FIGS. 5 and 6, in the second exemplary embodiment, an intermediate portion of a rod-shaped regulating member 30 is rotatably supported by a part of the outer circumferential face 12E of the container main body 12. Specifically, a supporting shaft 13 provided in the container main body 12 is inserted into a through hole formed in the intermediate portion of the regulating member 30. Further, a tip end portion 32 (on one end portion) of the regulating member 30 is formed in a hook shape (approximately triangular shape in the side sectional view of FIG. 6), and is inserted into the inside of the container main body 12 through an opening portion 36 formed in the container main body 12.

The opening portion 36 is formed on the other end portion in the axial direction (the coupling 21) with reference to the central portion of the developer supply container 10 in the axial direction, and is formed at a position separated from the other end portion. The opening portion 36 is sealed by a sealing member 38 made of rubber in which a small slit is cut so that only the tip end portion 32 of the regulating member 30 passes therethrough. Thus, even though the tip end portion 32 of the regulating member 30 is rotated to be extracted from the opening portion 36, the developer contained in the container main body 12 is not leaked outside through the opening portion 36 (slit).

Further, the regulating member 30 regulates (maintains) the position of a free end portion 26A in the transport section 26 of the rotating transport member 20 at a position separated from the other end portion toward the one end portion by a predetermined distance, until the packing member 46 that packs the other end portion of the developer supply container 10 (the container main body 12) in the axial direction (the coupling 21) is detached from the other end portion.

Specifically, the transport section 26 of the rotating transport member 20 in the developer supply container 10 before the packing member 46 is detached is elastically deformed so as to be compressed toward the one end portion of the container main body 12 in the axial direction, and the free end portion 26A disposed on the other end portion of the container main body 12 in the axial direction or a portion close to the free end portion 26A is pressed by the tip end portion 32 of the regulating member 30, and thus, the positional regulation is performed at the position (see FIG. 6).

Further, to a rear end portion 34 (on the other end portion) of the regulating member 30, one end portion 52A of a tape 52 that is an example of a stretch member is detachably joined, and the other portion 52B of the tape 52 is fixed to a side face 46A of the packing member 46 in a state where tension is given to the tape 52. Thus, the tip end portion 32 of the regulating member 30 is biased by the tension toward the inside of the container main body 12, and the free end portion 26A of the transport section 26 is pressed while overcoming an elasticity restoring force thereof.

That is, the unit 40 that moves the rotating transport member 20 by the operation of detaching the packing member 46 from the developer supply container 10 is configured by the regulating member 30 and the tape 52. The coupling 42 and the groove section 44 are not formed in the packing member 46. Further, the one end portion of the developer supply container 10 (container main body 12) in the axial direction is packed by the packing member 48, in a similar way to the first exemplary embodiment, and the opposite end portions of the developer supply container 10 are accommodated in the packing box 50 in the state of being packed by the respective packing members 46 and 48.

In the packing structure 11 of the developer supply container 10 according to the above-described second exemplary embodiment, operations thereof will be described as follows. Description about the same operations as in the first exemplary embodiment will be omitted.

Figure 7:
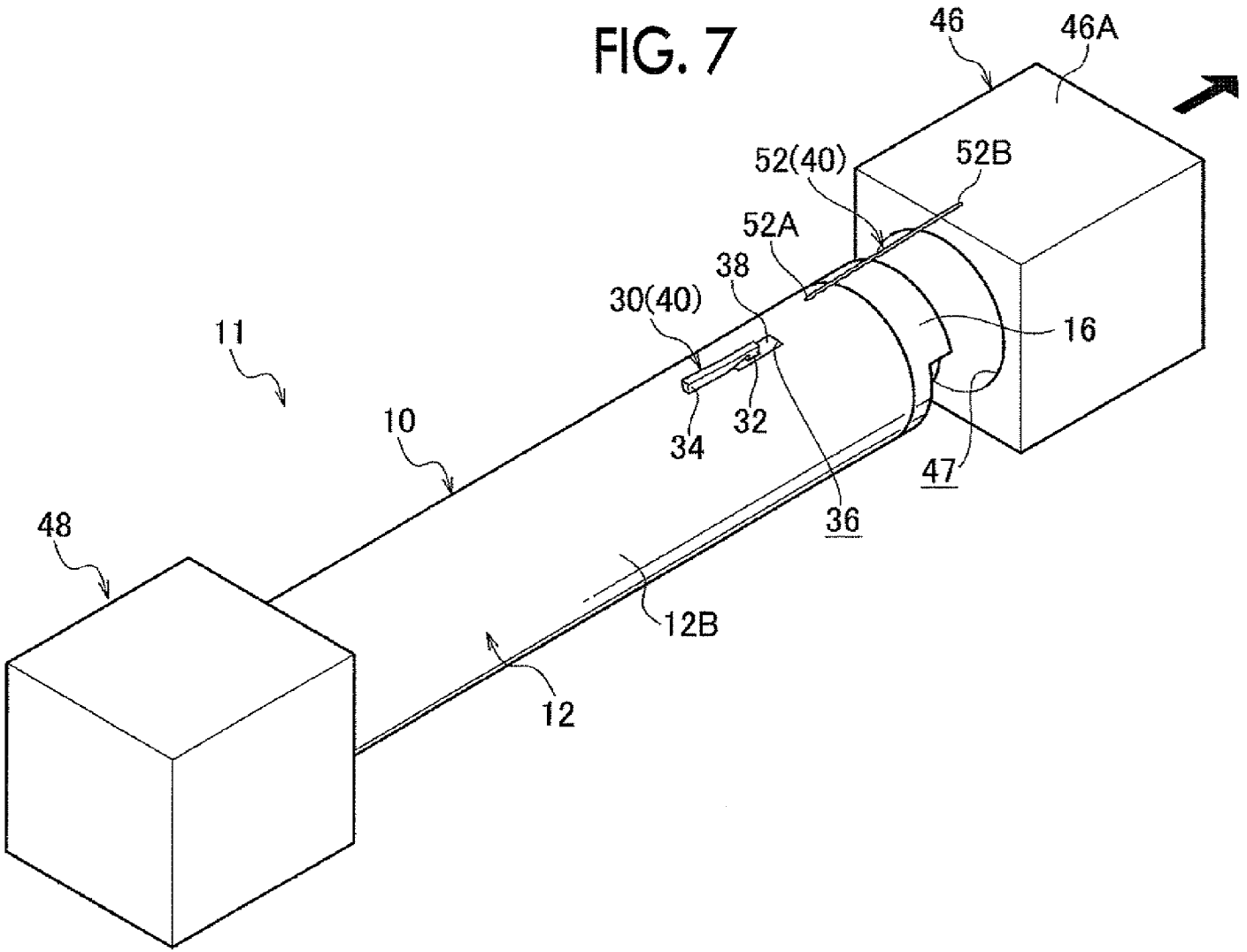
FIG. 7 is a perspective view illustrating a position regulation released state of the packing structure according to the second exemplary embodiment.
Figure 8:
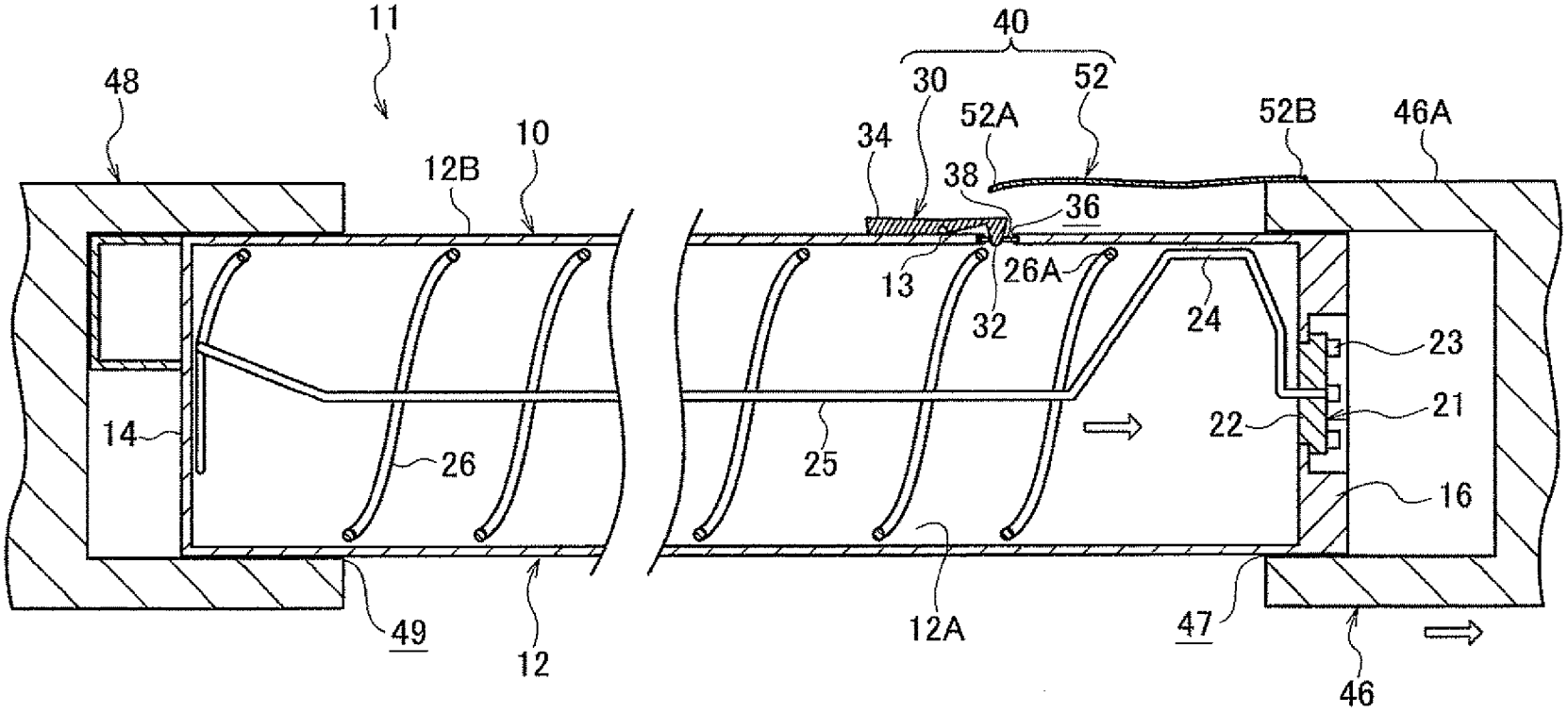
FIG. 8 is a cross-sectional view illustrating the position regulation released state of the packing structure according to the second exemplary embodiment.

In the developer supply container 10 detached from the packing box 50, the respective packing members 46 and 48 are detached from the opposite end portions in the axial direction, but as shown in FIGS. 7 and 8, as the packing member 46 is detached from the other end portion in the axial direction, one end portion 52A of the tape 52 joined to the rear end portion 34 of the regulating member 30 is separated from the rear end portion 34.

Then, since the biasing force does not act toward the inside of the container main body 12 (the position regulated state is released) in the tip end portion 32 of the regulating member 30, as shown in FIG. 8, the free end portion 26A of the transport section 26 is separated from the tip end portion 32 (withdrawn from the tip end portion 32) of the regulating member 30 by the elasticity restoring force thereof, and returns and moves along the axial direction toward the other end portion of the container main body 12 in the axial direction.

Accordingly, even though the developer contained in the developer supply container 10 is compressed, agglomerated and solidified by vibration applied thereto at the time of distribution, long-term storage or the like (particularly, vertically placed), the agglomeration and solidification of the developer is loosened by the operation of detaching the packing member 46 from the developer supply container 10 as described above. Accordingly, the initial driving torque with respect to the rotating transport member 20 is reduced when the developer supply container 10 is mounted to the image forming apparatus main body.

Finally, the packing structure 11 of the developer supply container 10 according to a third exemplary embodiment will be described. The same reference numerals are given to the equivalent portions as those of the second exemplary embodiment, and detailed description thereof will be described.

Figure 9:
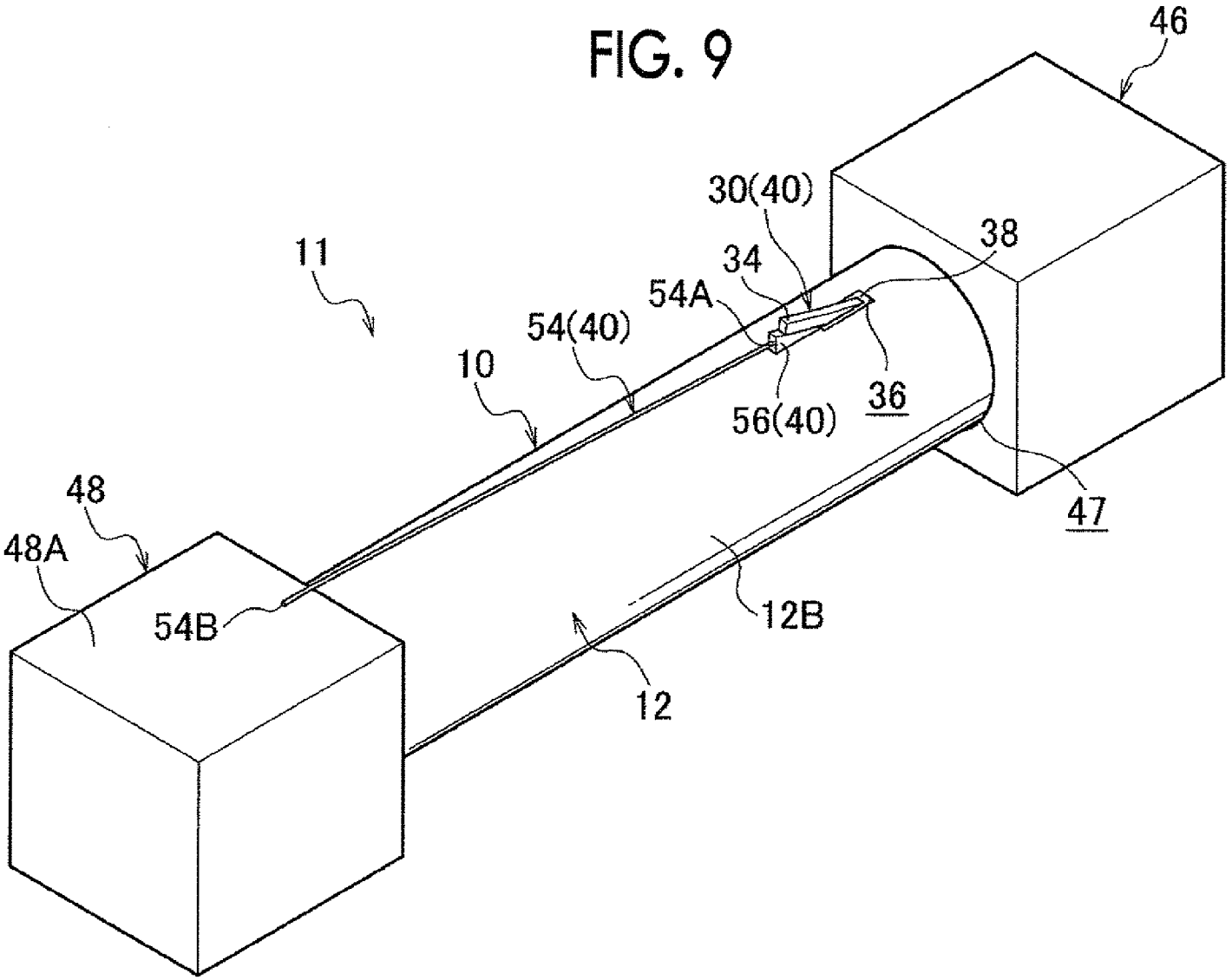
FIG. 9 is a perspective view illustrating a position regulated state of a packing structure according to a third exemplary embodiment.
Figure 10:
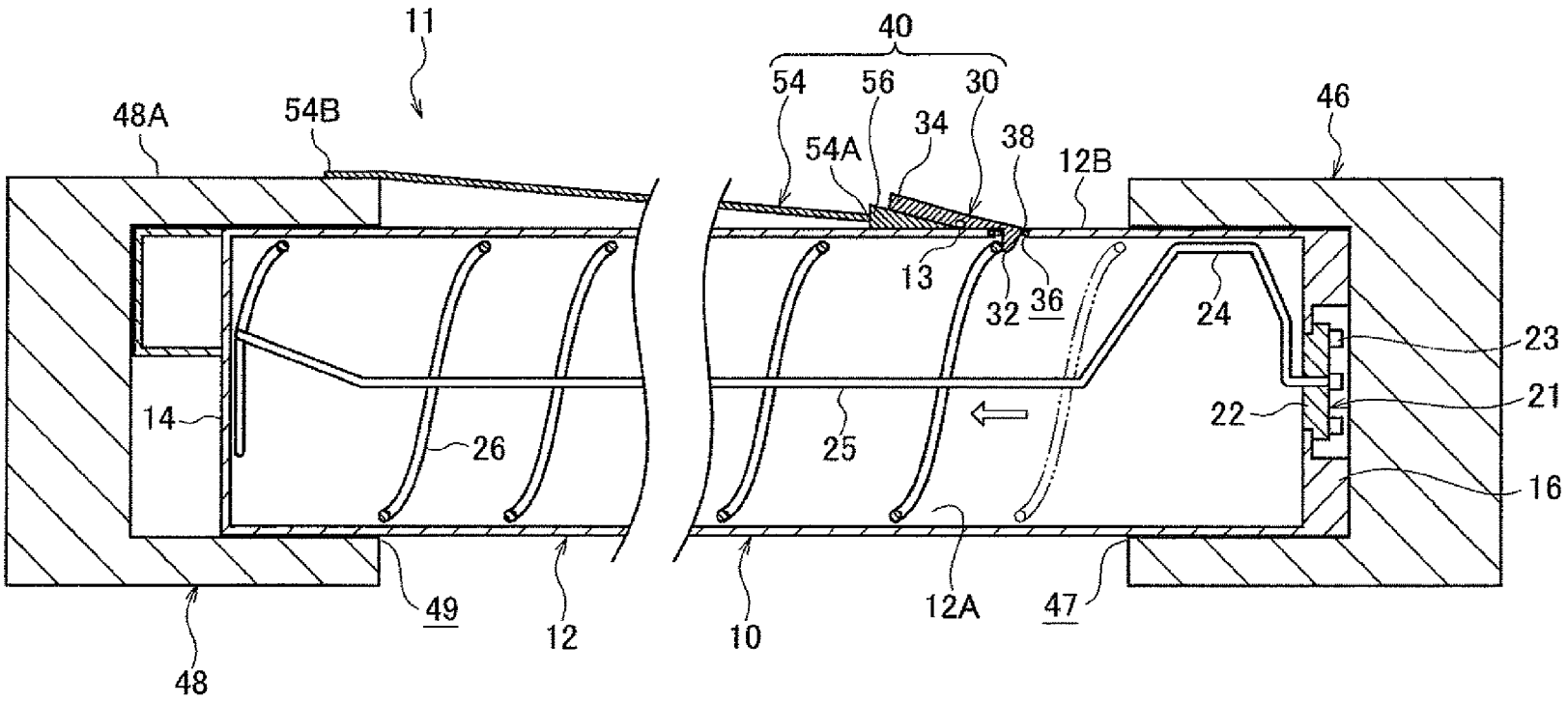
FIG. 10 is a cross-sectional view illustrating the position regulated state of the packing structure according to the third exemplary embodiment.

As shown in FIGS. 9 and 10, in the third exemplary embodiment, a maintaining member 56 is inserted into a gap between the rear end portion 34 of the regulating member 30 and the outer circumferential face 12B of the main body 12 so that the tip end portion 32 of the regulating member 30 in the second exemplary embodiment maintains the position regulated state with respect to the free end portion 26A of the transport section 26.

Specifically, the maintaining member 56 is formed in an approximately triangular column shape in which the tip end portion inserted into the gap forms an acute angle in the side sectional view of FIG. 10, and serves as a wedge that applies pressure so that the tip end portion 32 of the regulating member 30 maintains the state of being inserted into the container main body 12 (so that the tip end portion 32 of the regulating member 30 is not rotated in a direction extracting from the container main body 12).

Further, one end portion 54A of a tape 54 that is an example of a connecting member is attached to a rear end portion of the maintaining member 56, and the other end portion 54B of the tape 54 is fixed to a side face 48A of the packing member 48 that packs the one end portion of the container main body 12 in the axial direction. It is not necessary to give tension to the tape 54, and it is sufficient if the tape 54 has the function of connecting the maintaining member 56 to the packing member 48.

That is, the unit 40 that moves the rotating transport member 20 by the operation of detaching the packing member 48 from the developer supply container 10 is configured by the tape 54, the regulating member 30 and the maintaining member 56. The other end portion of the developer supply container 10 (container main body 12) in the axial direction is packed by the packing member 46, but the coupling 42 and the groove section 44 may not be provided in the packing member 46. Further, the opposite end portions of the developer supply container 10 in the axial direction are accommodated in the packing box 50 in the state of being packed by the respective packing members 46 and 48.

In the packing structure 11 of the developer supply container 10 according to the above-described third exemplary embodiment, operations thereof will be described as follows. Description about the same operations as in the first and the second exemplary embodiments will be appropriately omitted.

Figure 11:
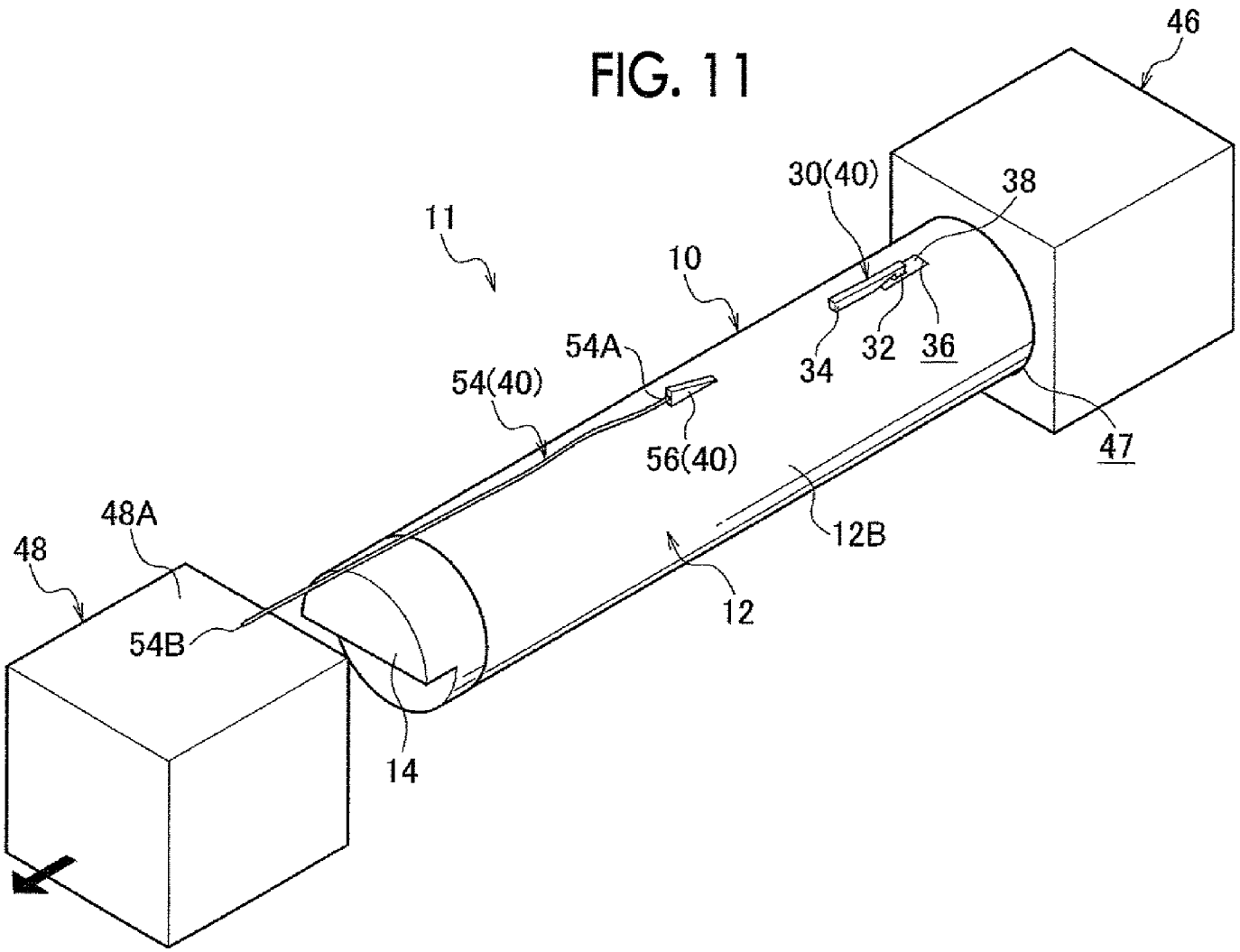
FIG. 11 is a perspective view illustrating a position regulation released state of the packing structure according to the third exemplary embodiment.

In the developer supply container 10 extracted from the packing box 50, the respective packing members 46 and 48 are extracted from the opposite end portions in the axial direction, but as shown in FIG. 11, if the packing member 48 is extracted from the one end portion in the axial direction, the maintaining member 56 inserted in the gap between the rear end portion 34 of the regulating member 30 and the outer circumferential face 12B of the container main body 12 is extracted.

Then, since the biasing force does not act toward the inside of the container main body 12 (the position regulated state is released) in the tip end portion 32 of the regulating member 30, as shown in FIG. 8, the free end portion 26A of the transport section 26 is separated from the tip end portion 32 (withdrawn from the tip end portion 32) of the regulating member 30 by the elasticity restoring force thereof, and returns and moves along the axial direction toward the other end portion of the container main body 12 in the axial direction.

Accordingly, even though the developer contained in the developer supply container 10 is compressed, agglomerated and solidified by vibration applied thereto at the time of distribution, long-term storage or the like (particularly, vertically placed), the agglomeration and solidification of the developer is loosened by the operation of detaching the packing member 48 from the developer supply container 10 as described above. Accordingly, the initial driving torque with respect to the rotating transport member 20 is reduced when the developer supply container 10 is mounted to the image forming apparatus main body.

Hereinbefore, the packing structure 11 of the developer supply container 10 according to the present exemplary embodiment has been described with reference to the drawings, but the packing structure 11 of the developer supply container 10 according to the present exemplary embodiment is not limited thereto, and various modifications, changes and improvements may be made.

For example, the other end portion 54B of the tape 54 according to the third exemplary embodiment may be fixed to the side face 46A of the packing member 46 that packs the other end portion of the developer supply container 10 in the axial direction. In this case, the transport section 26 (free end portion 26A) returns and moves along the axial direction by the operation of detaching the packing member 46 from the developer supply container 10.

Further, it is preferable that the maintaining member 56 according to the third exemplary embodiment be integrally handled together with the packing member 48 by the tape 54. Accordingly, when the developer supply container 10 is mounted to the image forming apparatus main body, it is possible to prevent the maintaining member 56 from causing a trouble that the maintaining member 56 is mistakenly inserted into the image forming apparatus main body.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A packing structure of a developer container, comprising:

a developer container that contains a developer in a main body of the developer container and the developer is discharged through a supply port that is formed in a wall of the developer container;

a transport member that is rotatably disposed in the main body; and a packing member that packs the developer container and moves the transport member by an operation of detaching the packing member from the developer container, the packing member rotating the transport member about a rotational axis of the transport member by operation thereof.

2. The packing structure according to claim 1, wherein the developer container includes a protruding member that is provided on a container outer face, wherein the transport member includes an engaging section to which a rotational driving force is transmitted from an image forming apparatus main body to which the developer container is mounted, and wherein the unit that moves the transport member includes:

an engaging target section that is provided in the packing member and is engaged with the engaging section in the state of being packed by the packing member, and a groove section that is formed in the packing member and guides the protruding member in at least a circumferential direction of the transport member in a state where the engaging section and the engaging target section are engaged with each other.

3. The packing structure according to claim 1, wherein the developer container includes an opening and closing member that is movably provided along a container outer face and opens and closes the supply port, wherein the transport member includes an engaging section to which a rotational driving force is transmitted from an image forming apparatus main body to which the developer container is mounted, and wherein the unit that moves the transport member includes:

an engaging target section that is provided in the packing member and is engaged with the engaging section in the state of being packed by the packing member, and a groove section that is formed in the packing member and guides the opening and closing member in at least a circumferential direction of the transport member in a state where the engaging section and the engaging target section are engaged with each other.

4. The packing structure according to claim 3, wherein the groove section guides the opening and closing member so that the transport member is rotated in a reverse direction to a transport direction where the developer is transported to the supply port.

5. The packing structure according to claim 1, wherein the developer container comprising an engagement portion that transmits rotating force to the transport member, and the packing member comprising a groove portion that engages with the engagement portion when the developer container is packed, and guides the engagement portion by the operation so that the transport member is rotated.

6. The packing structure according to claim 5, wherein the transport member transports the developer toward the supply port when rotated in a rotating direction, and the groove portion guides the engagement portion so that the transport member is rotated in a direction that is opposite to the rotating direction of the transport member.

* * * * *